US006494661B1

(12) United States Patent
Hobbs

(10) Patent No.: US 6,494,661 B1
(45) Date of Patent: Dec. 17, 2002

(54) DEVICE AND METHOD FOR PROVIDING A COVER FOR A BOOK

(75) Inventor: John N. Hobbs, Troy, OH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/569,704

(22) Filed: May 12, 2000

(51) Int. Cl.[7] ..... B42C 7/100; B42C 1/100; B65H 5/30

(52) U.S. Cl. ..... 412/4; 412/5; 412/8; 412/19; 270/52.14; 270/52.18; 270/52.24; 270/52.28; 270/58.05; 270/58.08; 270/58.24

(58) Field of Search ..... 412/4, 5, 8, 19; 270/52.14, 52.18, 52.24, 52.28, 58.05, 58.08, 58.24

(56) References Cited

U.S. PATENT DOCUMENTS 4,420,148 A 12/1983 Meadows ..... 270/41
4,556,353 A * 12/1985 Ehlermann ..... 412/5
4,988,086 A * 1/1991 Schlough ..... 270/52
5,413,446 A * 5/1995 Rathert et al. ..... 412/17
5,570,985 A * 11/1996 Latvakangas et al. ..... 412/4
5,871,323 A * 2/1999 Clark ..... 412/19
5,975,823 A * 11/1999 Schlough ..... 412/8
5,980,181 A * 11/1999 Franks ..... 412/19
6,142,721 A * 11/2000 Marsh ..... 281/21.1
6,199,851 B1 * 3/2001 Latvakangas et al. .... 270/58.08

* cited by examiner

*Primary Examiner*—A. L. Wellington
*Assistant Examiner*—Mark T. Henderson
(74) *Attorney, Agent, or Firm*—Davidson, Davidson & Kappel, LLC

(57) ABSTRACT

A method for covering a book includes delivering a book into a pocket, delivering an inverted cover for the book into the pocket, the cover having a first side and a second side, the first side of the cover contacting a side of the book in the pocket, and reversing the second side of the cover so as to contact another side of the book. Also disclosed is a book covering device including a plurality of movable pockets for receiving a book and an inverted cover, each pocket having a support wall and a spine stop movable with respect to the support wall, and each pocket including a cover reversing device for reversing the inverted cover.

5 Claims, 2 Drawing Sheets

DEVICE AND METHOD FOR PROVIDING A COVER FOR A BOOK

BACKGROUND OF THE INVENTION

1. Field of the Invention

The present invention relates generally to book binding and more particularly to a device and method for providing a cover for a book.

2. Background Information

To form books (defined herein to include all sheet and signature assemblages), sheets or signatures typically are collated or assembled so that the sheets of the book are arranged in the desired order. U.S. Pat. No. 4,988,086 discloses, for example, an apparatus and method for forming sheet material assemblages. The sheets or signatures are stacked above continuously moving assemblers or pockets and dropped one-by-one into the pockets. The bottom of the pocket can open to release an assembled, but unbound, book.

To prepare books for binding, the sheets or signatures must then be registered, so that all edges are even. The spine will be flat if a flatback book is to be formed. If signatures rather than individual sheets are collated, the backbone of the book typically will be sawed so that individual sheets within each signature present themselves at the spine.

U.S. Pat. No. 4,556,353 discloses a method for applying an adhesive to the spine of a book and providing a cover to the book. The book is gripped from the top by clamps to expose the spine of the book and to move the spine past a glue station. A cover glue station may also be provided. Glue is provided to an inner side of the cover, which is moved in a direction parallel to the length of the spine of the book so as to overlap with the spine of the book. The side of the cover may then be pressed about the book.

The above-referenced patent has the disadvantage that the covering process is time-consuming and complicated. Moreover, separate transport devices for moving both the cover and the books are required and must be accurately timed for proper alignment of the cover and the book. The need for an accurate alignment of the cover and the book increases the chances for malfunction or a reduction in quality.

Moreover, transporting the book and cover parallel to the spine length results in high linear velocities. The clamping mechanism must be substantial to hold the book. The time for the glue to set is also limited, in that it is impractical with high velocities to provide a track having a long enough length for a clamping system to hold the book before the book must be delivered from the clamp.

BRIEF SUMMARY OF THE INVENTION

An object of the present invention is to provide a method and device for providing a cover for a book without requiring two separate transport devices for matching the cover with the book. Another alternate or additional object of the present invention is to provide a method and device for providing a book cover while the book is being transported in a direction perpendicular to the length of the book spine. Yet another alternate or additional object of the present invention is to permit for more efficient covering of the book.

The present invention provides a method for covering a book including delivering a book into a pocket, and delivering an inverted cover for the book into the pocket, the cover having a first side and a second side. The first side of the cover contacts a side of the book in the pocket. The second side of the cover then travels around the end or spine of the book, i.e. reverses, so that the second side contacts another side of the book.

By delivering the cover into the pocket along with the book, a separate cover transport mechanism which must align linearly with the book transport mechanism need not be provided. Rather a simple collator above the pockets can be used to deliver the covers. Moreover, the present method permits the transport of the book in a direction perpendicular to the length of the spine of the book.

The delivering step may include aligning the book in an unbound state against a pivotal spine stop, and aligning the cover against the same spine stop. Once the cover and the book are aligned, a suction device can move the second side of the cover away from the book and the first side of the cover. The book and the first side of the cover can then be held at a top end by a clamp, and the spine stop removed.

The suction device then rotates the second side of the cover so that the second side moves downwardly. The second side may then be brought about the spine by a sloped ramp. A conveyor belt may then support the second cover side in a generally horizontal position and the book and the first side of the cover can be released so as to slide onto the second side of the cover, thus forming a fully covered book.

The first side and the second side of the cover may have pre-applied glue strips. Gluing stations for the first side, spine and/or second side are also possible. However, the present invention may be used without any gluing stations to provide a loose cover for the book.

The present invention also provides a book covering device including a plurality of movable pockets for receiving a book and an inverted cover, each pocket having a support wall and a spine stop movable with respect to the support wall, and each pocket including a cover reversing device for reversing the inverted cover.

The cover reversing device preferably includes a pivot arm with a rotatable suction device, the suction device suctioning the second side of the cover so as to move the second side downwardly.

Each pocket also preferably includes a clamp for holding a top end of the first side of the cover and the book while the cover is reversed.

The device preferably also includes a sloped table for aiding the cover reversing process and a conveyor for receiving the covered books.

The movements of the movable parts of the pockets preferably are cam-actuated, but also may be driven by individual motors.

"Book" as defined herein can mean any type of sheet or signature assemblage in bound or unbound state, including but not limited to, covered printed products, paper booklets, and magazines. The book need not have a spine flat spine, and may include a saddle-stitched book.

BRIEF DESCRIPTION OF THE DRAWINGS

A preferred embodiment of the present invention is described below by reference to the following drawings, in which.

DETAILED DESCRIPTION

Figure 1:
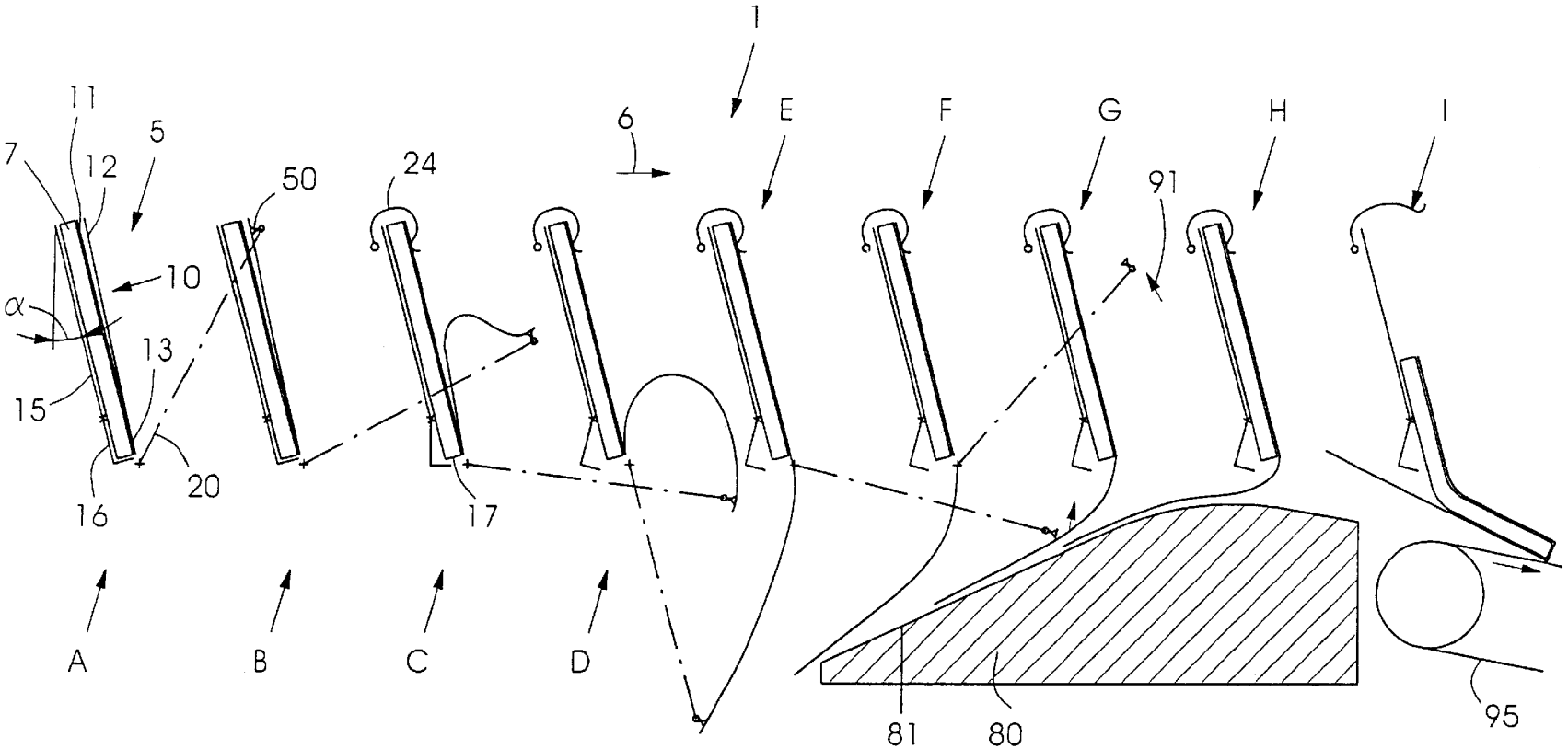
FIG. 1 shows a schematic side view of the book covering device according to the present invention.

FIG. 1 shows a schematic side view of an embodiment of a book covering device 1 according to the present invention. The book covering device has a plurality of pockets 5 traveling in a direction 6, for example by a chain drive on one side of the pockets. A book already bound at the spine may be placed in the pockets 5. Alternately, stacks of signatures or sheets sit above pockets and are delivered by belts into the pockets in a collator section in known fashion. Examples of such collators include those described in U.S. Pat. No. 4,988,086 and in U.S. Ser. No. 09/570,203 entitled "Device and Method for Preparing a Book Spine for Binding" to James Schlough, filed on the same date as the present application, both of which are hereby incorporated by reference herein.

Each pocket has a support wall 15 and a spine stop 16, rotatable with respect to support wall 15. As the products or books enter the pockets 5, they come to rest on a side against support wall 15, and on an edge against spine stop 16.

The collated products thus form a book 7 having a side which rests against support wall 15 and a spine against spine stop 16. A final collator station delivers an inverted cover 10 having a first side 11 and a second side 12, the cover 10 also resting against stop 16. Second side 12 may be slightly longer than first side 12 so as to compensate for the spine thickness, and may include a spine section 13.

Each pocket 5 also includes a cover reversing device 20. Pockets 5 are shown in more detail with respect to FIG. 2. Each pocket 5 includes support wall 15 and spine stop 16. Support wall 15 can be fixed with respect to a support 22, which may be for example metal sheets, one on each side of the support wall 15. Spine stop 16 is rotatable about a pivot or rod 17, supported rotatably in support 22.

Figure 3:
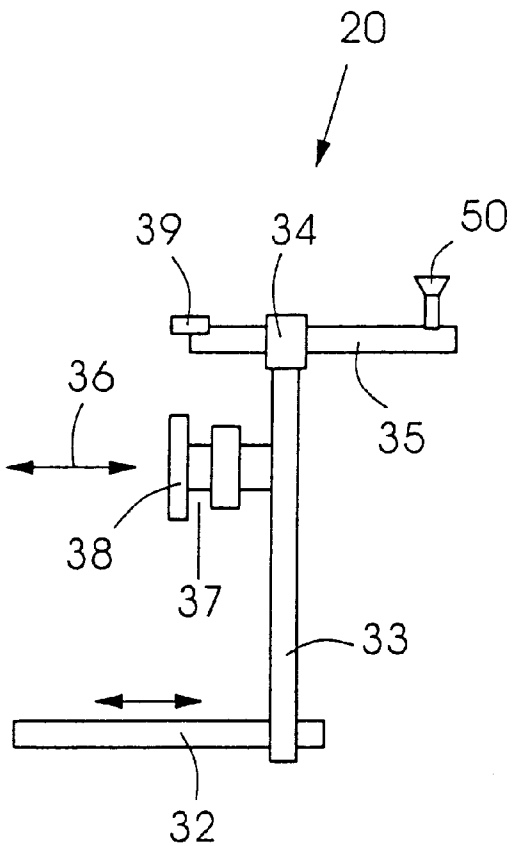
FIG. 3 shows details of the cover reversing device for a pocket.

Cover reversing device 20 includes a slide arm 32 supported in support 22, an arm 33 rotatably and slidably supported with respect to slide arm 32, and a rod bearing 34. Slide arm 32 is fixedly connected to support 22. Device 20 is shown in more detail in FIG. 3. A support rod 35 is rotatably supported in a bearing 34, and may extend past bearing 34 on both sides. On the support rod 35 is at least one suction devices 50. Suction device 50 may be connected, for example by a hose, to a vacuum device of pocket 5.

Rod 35 is rotatable in bearing 34 by a cam follower 39. Arm 33 is pivotable about slide arm 32, and may be rotated for example by a cam follower 38 on arm 33. Cam follower 38 also has a groove 37 which can permit an axial force to be exerted on arm 33, as shown by arrow 36. By forcing the cam follower as shown in arrow 36, arm 33 can slide along slide arm 32 in an axial direction. Cams for moving the cam followers can be provided at a side of the pockets.

Figure 2:
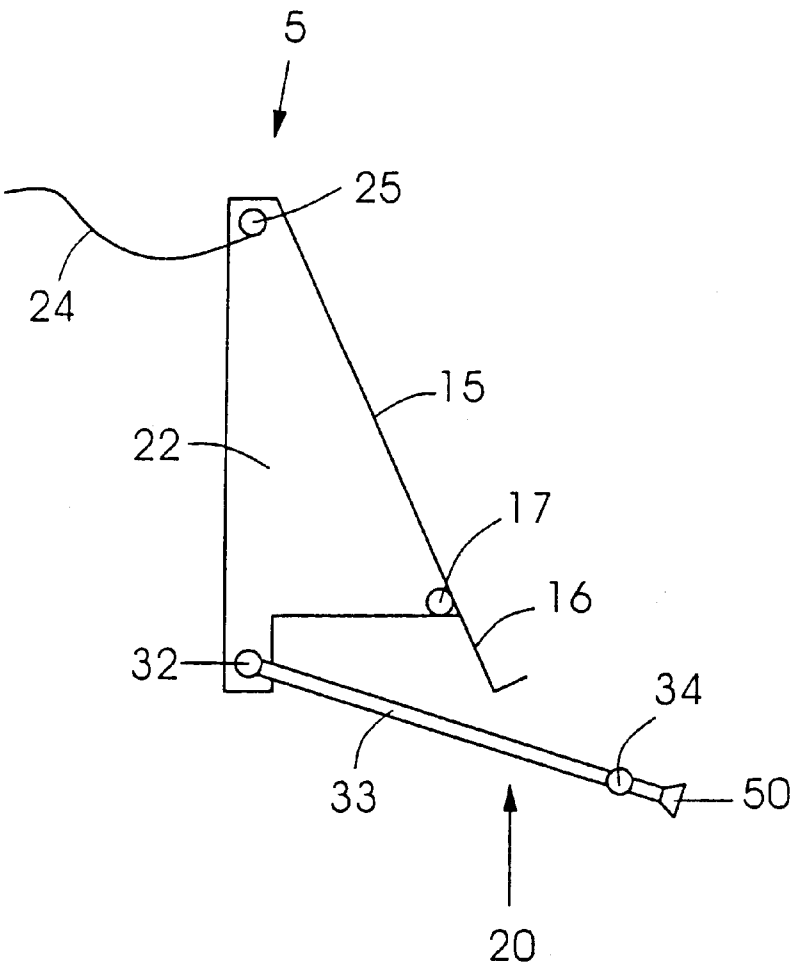
FIG. 2 shows details of the pockets the book covering device of FIG. 1.

As shown in FIG. 2, at a top of support 22 is a rotatable clamp 24, rotatably about a pivot 25. Clamp 24 also may be cam-actuated.

It should be understood that the movements of reversing device 20, rod 35 and clamp 24 could also be motor-driven.

FIG. 1 shows the progression of the cover 10 being moved to cover book 7. At section A of the device, the book 7 and cover 10 have been aligned against spine stop 16. First side 11 of cover 10 may have pre-applied glue or other adhesive which glues the first side 11 to book 7, although this is not necessary. Wall 15 preferably is at an angle a to the vertical, angle a preferably being between 15 and 45 degrees. At section A, reversing device 20 is in a similar position to that shown in section G.

At section B, reversing device 20 is actuated so that suction device 50 firmly grips second cover side 12 and begins to pull cover side 12 away from cover side 11 and book 7.

Cover side 12 is rotated away from first cover side 11 in section C, and clamp 24 is actuated to clamp the top of the book 7 and first cover side 11. Spine stop 16 is rotated away from the spine 17 of book 7. Spine stop 16 may be rotated for example by having a latch which is released by a cam follower and permits spine stop 16 to hang freely. The spine stop 16 may then be returned to the latched position by a cam before receiving a new book. Alternately, a cam can actuate the entire movement of stop 16 or stop 16 can be motor actuated.

In sections D and E, device 20 is shown further pulling cover side 12 downwardly. At section E, the device 20 removes suction and is slid axially along slide arm 32 to permit suction device 50 to clear sloped table 80 and the cover second side 12. The device 20 is then rotated upwardly as indicated by arrow 91 and may be moved axially inwardly again. At section F, the outside of cover side 12 contacts a sloped surface 81, and as cover side 12 rises at section G and H as shown. In section I, the top clamp 24 releases and book 7 slides onto a conveyor belt 95, the weight of the book 7 being such that book 7 slides onto the second side 12.

The fully covered books may be transported by the belt 95 for further processing.

It should be understood that the book 7 may first be glued and bound along a spine before entering the pocket 5, for example by the method described in incorporated-by-reference U.S. Ser. No. 09/570,203 entitled "Device and Method for Preparing a Book Spine for Binding" to James Schlough, filed on the same date as the present application. The open side of the book may be coated with a glue or adhesive before cover 10 is entered into pocket 5. Glue stations could be provided, for example, for the spine at section C and for the second cover side through spraying at section E. However, these glue stations are optional. Pre-pasted adhesives also could be used with cover 10 if adhesion of the cover is desired.

While the invention has been described with a soft or flexible cover 10, the present invention could also be used with a hard cover, in which case the cover reversing device would include an extra linkage between arm 33 and suction device 50. The pockets also would be spaced further apart to permit the hard cover to be lowered.

The motion of the pockets in direction 6 advantageously is perpendicular to a length of the book spine.

Instead of sloped table 80, a flat table could be used and the pockets lowered to aid in the reversing process.

Inverted cover as defined herein means a cover with two outer faces for a finished book facing each other.

What is claimed is:

1. A method for covering a book comprising the steps of:

delivering a book into a pocket;

delivering an inverted cover for the book into the pocket, the cover having a first side and a second side, the first side of the cover contacting a side of the book in the pocket; reversing the second side of the cover so as to contact another side of the book; and holding a top end of the book and the first side of the cover during the reversing step.

2. The method as recited in claim 1 further including releasing a spine stop after the holding step.

3. A method for covering a book comprising the steps of:

delivering a book into a pocket;

delivering an inverted cover for the book into the pocket, the cover having a first side and a second side, the first side of the cover contacting a side of the book in the pocket;

reversing the second side of the cover so as to contact another side of the book;

the reversing step including contacting the second side by a ramp sloped with respect to a pocket travel direction.

4. A book covering device comprising:

a plurality of movable pockets for receiving a book and an inverted cover, each pocket having a support wall and a spine stop movable with respect to the support wall, and each pocket including a cover reversing device for reversing the inverted cover; wherein each pocket includes a clamp for holding a top end of a first side of the cover and the book.

5. A method for covering books comprising the steps of:

delivering books into a plurality of pockets moving in a first direction, the first direction being perpendicular to spines of the books;

delivering an inverted covers for the books into the pockets so as to cover one side of the books; and reversing second sides of the covers so as to contact other sides of the books.

* * * * *